US007274279B2

(12) United States Patent
Iima

(10) Patent No.: US 7,274,279 B2
(45) Date of Patent: Sep. 25, 2007

(54) ELECTROMAGNETIC RELAY SYSTEM

(75) Inventor: Kohei Iima, Shizuoka (JP)

(73) Assignee: Asahi Denso Co., Ltd., Shizuoka (JP)

( * ) Notice: Subject to any disclaimer, the term of this patent is extended or adjusted under 35 U.S.C. 154(b) by 143 days.

(21) Appl. No.: 11/058,244

(22) Filed: Feb. 16, 2005

(65) Prior Publication Data

US 2005/0179510 A1 Aug. 18, 2005

(30) Foreign Application Priority Data

Feb. 18, 2004 (JP) ..... P. 2004-040696

(51) Int. Cl.
*H01H 67/00* (2006.01)

(52) U.S. Cl. ..... 335/106; 335/107; 335/119; 335/126

(58) Field of Classification Search ..... 335/106, 335/107, 119, 121, 126, 127, 131, 132, 256, 335/266–268
See application file for complete search history.

(56) References Cited

U.S. PATENT DOCUMENTS 3,217,124 A * 11/1965 Terry ..... 335/187
3,571,770 A * 3/1971 Dew ..... 335/256

* cited by examiner

*Primary Examiner*—Ramon M. Barrera
(74) *Attorney, Agent, or Firm*—Sughrue Mion pllc.

(57) ABSTRACT

An electromagnetic relay system is constituted by containing an electromagnetic relay arranged in a case and including a coil, a movable contact and a plurality of fixed contacts, a positive terminal and a negative terminal formed to project from the case, and load terminals formed to project from the case and connectable to a motor. An electric current flowing in the motor is controlled by controlling an electric current flowing in the coil. A ground line extended from the coil is connected to the negative terminal via a coil spring in the case.

5 Claims, 5 Drawing Sheets

ELECTROMAGNETIC RELAY SYSTEM

This application claims foreign priority based on Japanese patent application No. JP-2004-040696, filed on Feb. 18, 2004, the contents of which is incorporated herein by reference.

BACKGROUND OF THE INVENTION

The present invention relates to an electromagnetic relay system for controlling an electric current flowing in a load by controlling an electric current flowing in a coil of a relay means.

An electromagnetic relay system of a related art, for example, an electromagnetic relay system for controlling an operation of a winch or the like mounted on an ATV (All Terrain Vehicle), is constituted by containing an electromagnetic relay comprising two coils and a plurality of fixed terminals in a substantially hermetically closed case made of a resin and including a plurality of terminals formed by being projected from the case. In the electromagnetic relay system, a motor as a drive source of the winch or the like regularly rotates when an electric current is flowed in one of the coils, and the motor reversely rotates when the electric current is flowed in the other of the coils.

Further, specifically, the electromagnetic relay system comprises a positive terminal and a negative terminal both connectable to a power source of a battery or the like arranged at the ATV and a load terminal connectable to the motor for driving the winch. The electromagnetic relay system further comprises control wirings extended from a change over switch separately arranged and connected to respectives of the coils of the respective electromagnetic relays. The electromagnetic relay system is constituted to be able to arbitrarily rotate regularly and reversely the motor by selectively making currents flow to the respectives of the coils at the respective electromagnetic relays via the control wirings.

Meanwhile, according to the above-described electromagnetic relay system of the related art, whereas one end of the coil constituting the electromagnetic relay is connected to the control wiring, a ground line extended from the coil is extended from the case to an external portion and a front end thereof is connected to the negative terminal. That is, according to the coil constituting the electromagnetic relay, when the electric current flows from the control wiring, the electric current reaches to the negative terminal via the ground line and is grounded therefrom.

However, since the above-described electromagnetic relay system of the related art is constituted by extending the ground line of the coil constituting the electromagnetic relay from the case to the external portion and connecting the ground line to the negative terminal and therefore, it is necessary to form a through hole for inserting the ground line through the case and it is necessary to fit a grommet or to fill a resin for waterproofing the through hole.

SUMMARY OF THE INVENTION

The present invention has been carried out in view of such a situation and it is an object thereof to provide an electromagnetic relay system connecting a ground line of a coil constituting an electromagnetic relay to a negative terminal at an inner portion of the case and capable of promoting waterproof performance.

In order to achieve the object, an electromagnetic relay system according to a first aspect of the present invention comprises an electromagnetic relay arranged in a case and including a coil, a movable contact and a plurality of fixed contacts, a positive terminal and a negative terminal formed to project from the case and capable of being connected to a power source, and a load terminal formed to project from the case and connectable to a load, wherein an electric current flowing in the load is controlled by controlling an electric current flowing in the coil of the electromagnetic relay, and wherein a ground line extended from the coil is connected to the negative terminal in the case.

In addition to the electromagnetic relay system of the first aspect, in the electromagnetic relay system of a second aspect, the electromagnetic relay may be arranged with a board in the case and the ground lines extended from the respective coils may be connected to the negative terminal via the board.

In addition to the electromagnetic relay system of the second aspect, in the electromagnetic relay system of a third aspect, a spring made of a conductive material may interpose between the board and the negative terminal and the ground lines may be connected to the negative terminal via the spring.

Moreover, in addition to the electromagnetic relay system of any one of first to third aspects, in the electromagnetic relay system of a fourth aspect, the electromagnetic relay may comprise a multiple connected type electromagnetic relay arranged with a plurality of the coils in the case.

According to the first aspect of the present invention, the ground line of the coil constituting the electromagnetic relay is connected to the negative terminal at inside of the case and therefore, it is not necessary to provide a through hole for the ground line to the case and a waterproof performance of the electromagnetic relay system can be promoted.

According to the second aspect of the present invention, the ground lines extended from the coils of the electromagnetic relay are connected to the negative terminal via the board arranged in the case and therefore, wiring can be simplified and operability in fabricating the electromagnetic relay system can be promoted.

According to the third aspect of the present invention, the ground lines are connected to the negative terminal via the conductive spring extended from the board and therefore, the connection is executed while exerting an elastic force of the spring, and wiring of the electromagnetic relay system can further be simplified.

According to the fourth aspect of the present invention, wiring of the multiple connected type electromagnetic relay can be simplified and waterproof performance of the electromagnetic relay system can be promoted.

DESCRIPTION OF THE PREFERRED EMBODIMENTS

Figure 1:
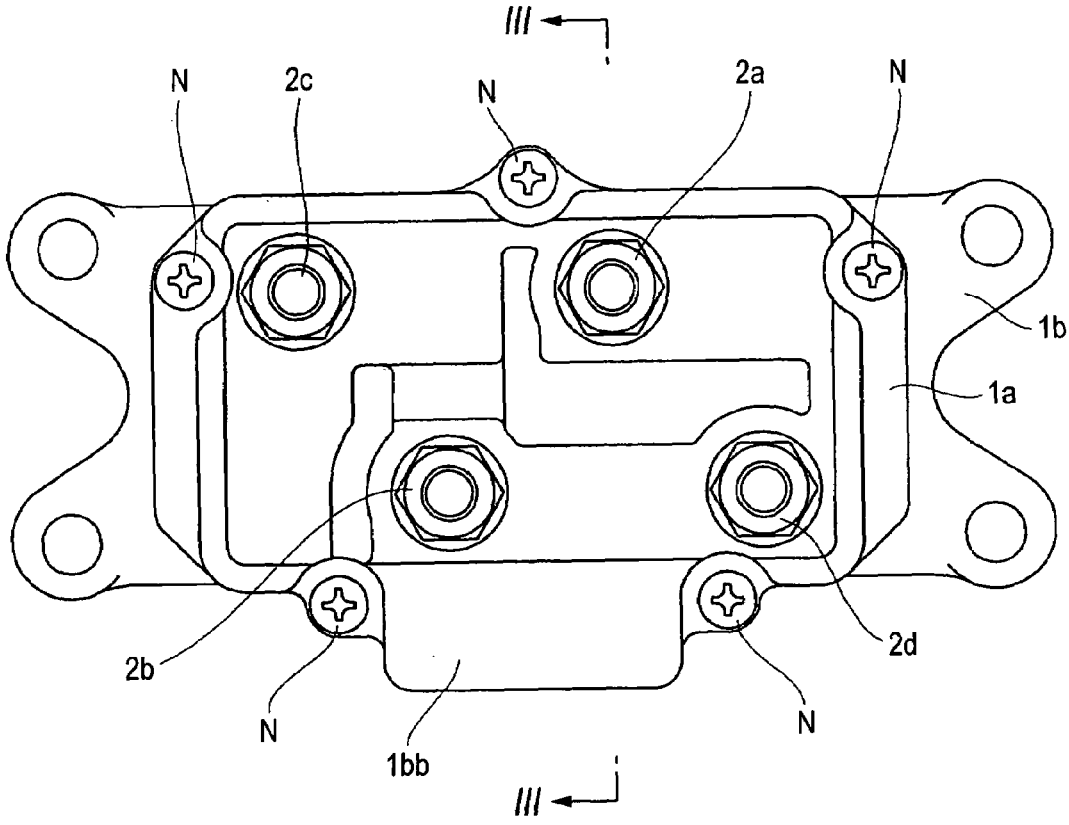
FIG. 1 is a top view showing an electromagnetic relay system according to an embodiment of the invention.
Figure 2:
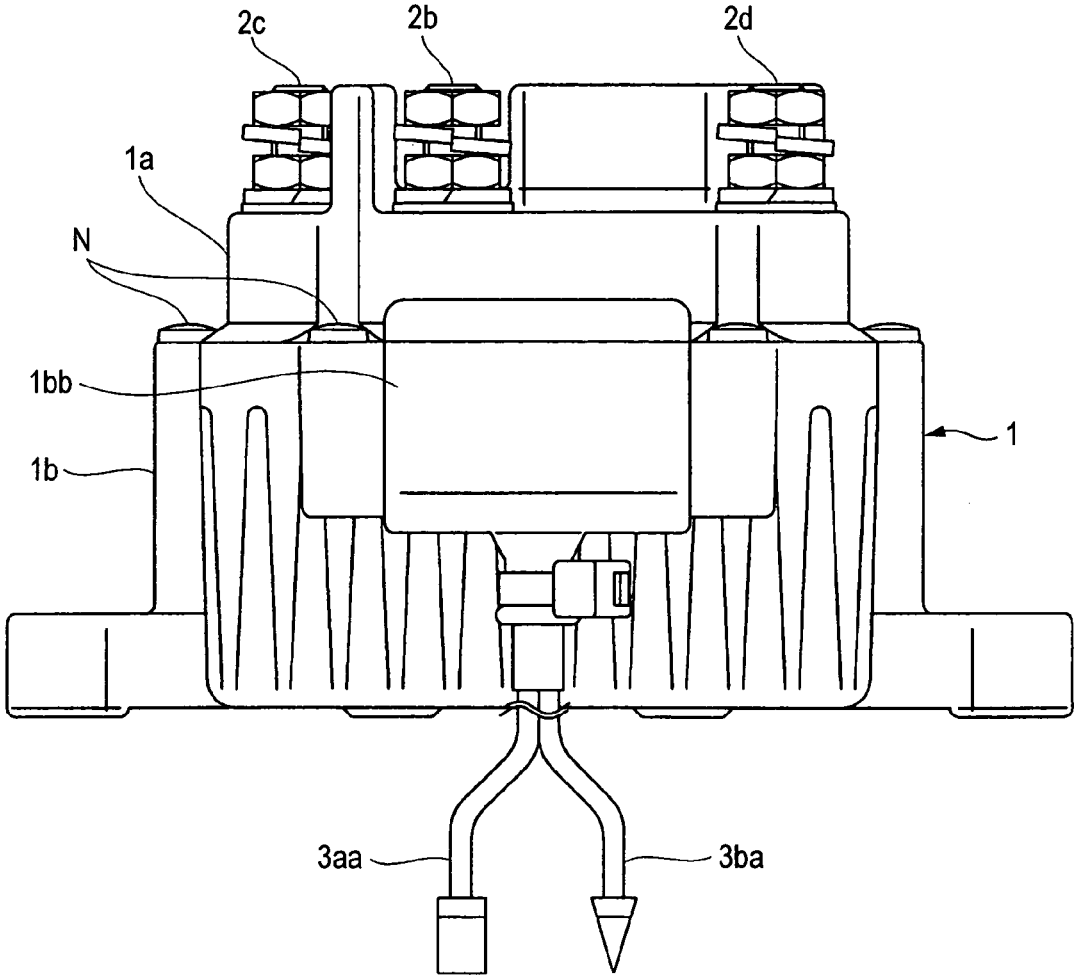
FIG. 2 is a front view showing the electromagnetic relay system.
Figure 3:
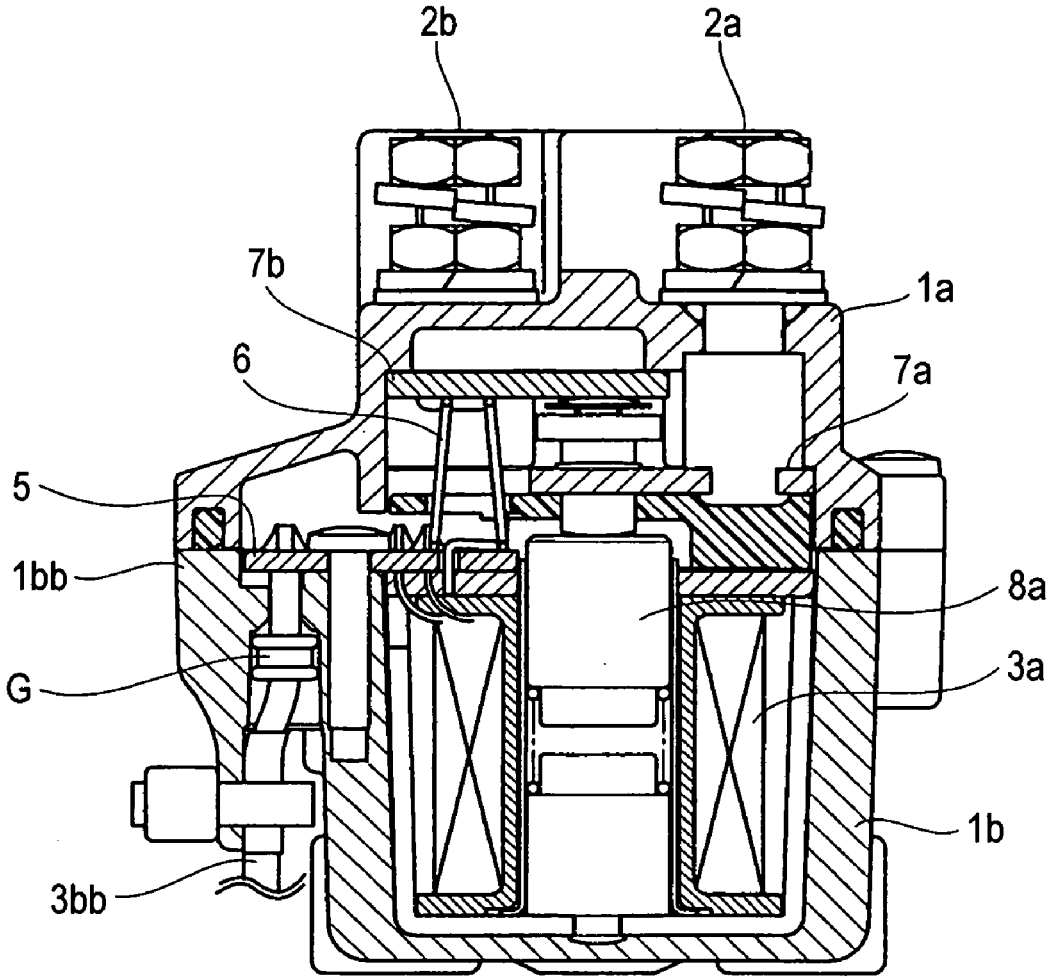
FIG. 3 is a sectional view taken along a line III-III in FIG. 1.

A detailed explanation will be given of an embodiment of the invention in reference to the drawings as follows.

In an electromagnetic relay system according to the embodiment, a motor for driving a winch mounted on an ATV (All Terrain Vehicle) is selectively rotated in a regular direction or a reverse direction. The electromagnetic relay system is essentially constituted by a case 1 comprising a lid 1*a* and a cabinet 1*b*, an electromagnetic relay 4 comprising a plurality of terminals 2*a* through 2*d* formed to project upward from the lid 1*a* of the case 1, coils 3*a*, 3*b* (refer to FIG. 4) and a plurality of fixed contacts, aboard 5 arranged at a vicinity of an opening portion of the cabinet 1*b*, and a coil spring 6 made of a conductive material of copper, phosphor bronze or the like.

Inside of the cabinet 1*b* of the case 1 is contained with the coils 3*a*, 3*b*, movable contacts 8*b*, 9*b* and a plurality of fixed terminals 7*a*, 7*b*, 7*d*, 7*e*, the board 5 and the coil spring 6. The terminals 2*a* and 2*b* constitute a positive terminal and a negative terminal respectively connectable to a positive pole and a negative pole of a battery (not illustrated) constituting a power source. The terminals 2*c* and 2*d* constitute terminals for a load which can respectively be connected to a motor M as the load. Further, the cabinet 1*b* is attached with the lid 1*a* after containing the above-described various constituent elements at inside of the cabinet 1*b*. The lid 1*a* and the cabinet 1*b* are fixed by a plurality of screws N. An inside of the case 1 is constituted by a hermetically closed structure.

Figure 4:
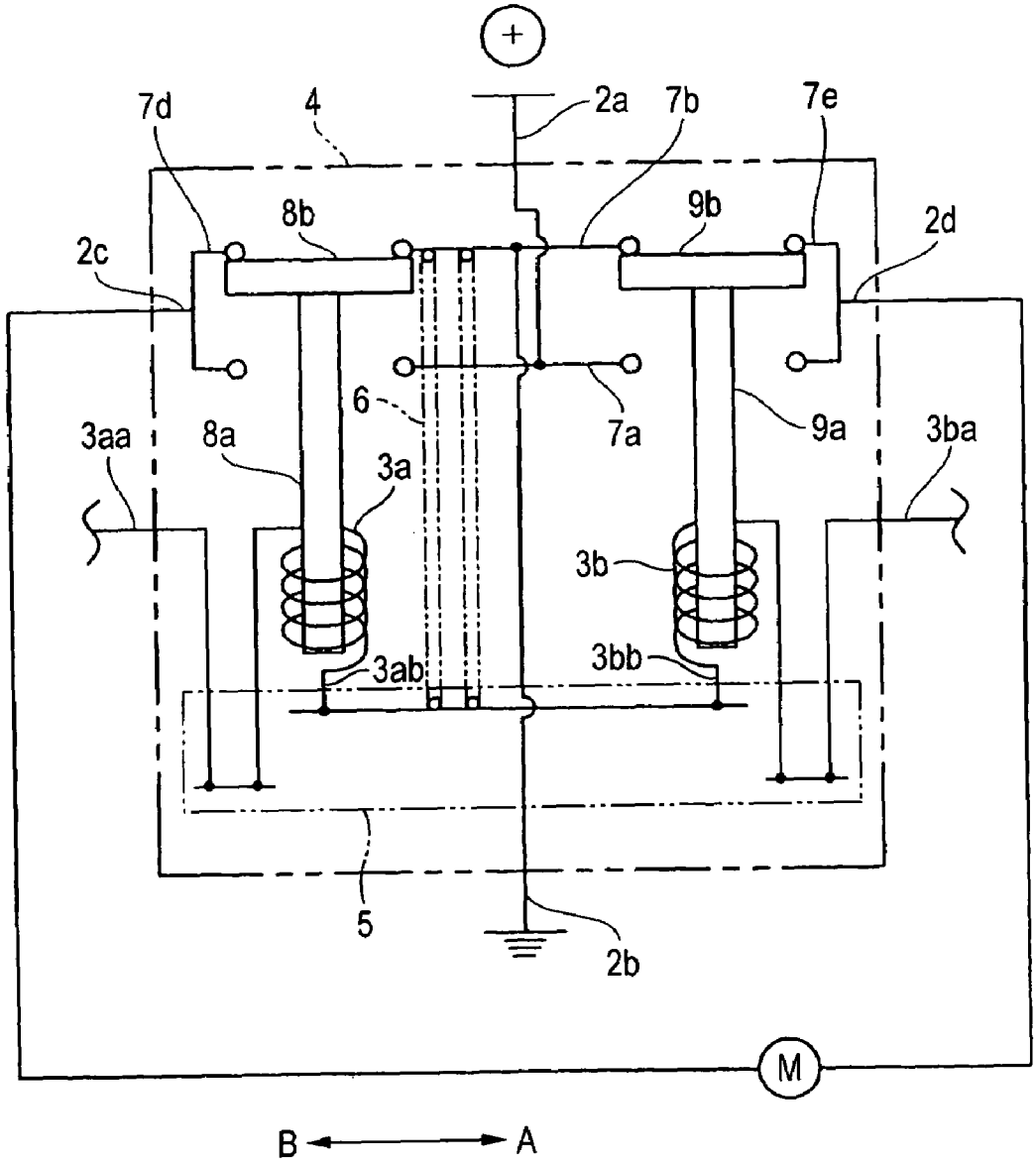
FIG. 4 is a wiring diagram showing the electromagnetic relay system according to the embodiment of the invention.

Further, as shown in FIG. 4, a base end of the positive terminal 2*a* is connected to the fixed contact 7*a*, a base end of the negative terminal 2*b* is connected to the fixed contact 7*b*, and the fixed contact 7*b* of the fixed contacts is connected to the board 5 via the coil spring 6. The coils 3*a* and 3*b* are constituted by connecting both ends thereof to a pair of control wirings 3*aa* and 3*ba* extended from operating means 10 shown in FIG. 5 and to ground lines 3*ab* and 3*bb*. By operating a switch S of the operating means 10, it is possible to arbitrarily select whether an electric current is made to flow to the coil 3*a* via the control wiring 3*aa* or whether an electric current is made to flow to the coil 3*b* via the control wiring 3*ba*.

Further, the cabinet 1*b* is formed with a bulged portion 1*bb*. The bulged portion 1*bb* is formed with an opening directed to a lower side of the electromagnetic relay system. The control wirings 3*aa* and 3*ba* are inserted from the opening and connected to predetermined portions of the board 5. That is, the control wirings 3*aa* and 3*ba* are electrically connected to respectives of the coils 3*a* and 3*b* via the board 5. Further, notation G in the drawing designates a seal member for filling to seal gaps between the opening of the bulged portion 1*bb* and the control wirings 3*aa* and 3*ba*.

Meanwhile, a print wiring is printed on the board 5. The ground lines 3*ab*, 3*bb* extended from the coils 3*a* and 3*b* are connected to the print wiring and further connected the fixed contact 7*b* via the coil spring 6. Thereby, an electric current flowed in the board 5 reaches to the negative terminal 2*b* via the fixed contact 7*b*.

Further, the coils 3*a* and 3*b* are respectively inserted with iron cores 8*a* and 9*a*, and when the iron core 8*a* or 9*a* is operated by a magnetic field generated by an electric current flowed to the coil 3*a* or 3*b*, the movable contact 8*b* or 9*b* provided at a front end of the iron core 8*a* or 9*a* is constituted to move from a position spanning the fixed contact 7*b* and the fixed contact 7*d* or 7*e* to a position spanning the fixed contact 7*a* and the fixed contact 7*d* or 7*e*.

Figure 5:
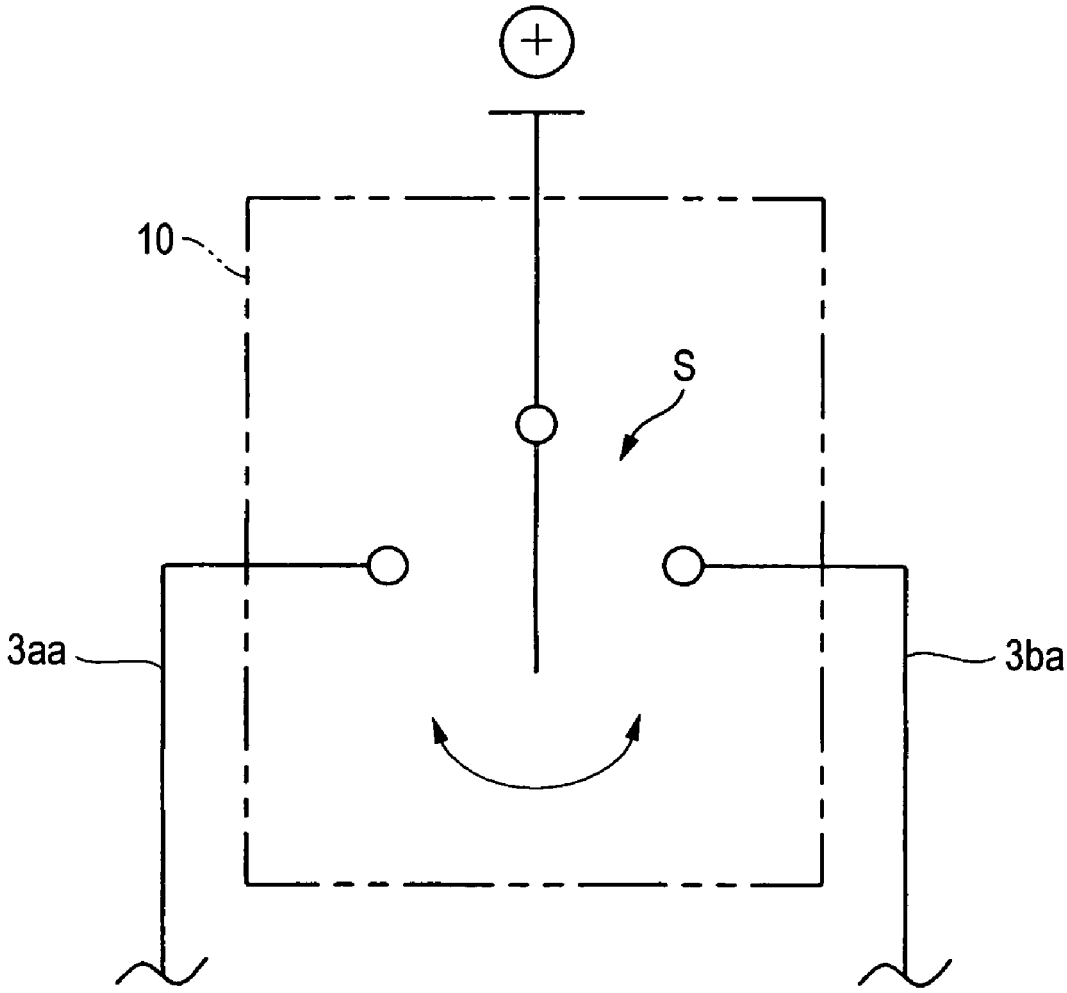
FIG. 5 is a wiring diagram showing operating means applied to the electromagnetic relay system.

That is, when the switch S of the operating means 10 is moved to the left side in FIG. 5, the electric current is made to flow to the coil 3*a*, and therefore, the iron core 8*a* is moved to the lower side in FIG. 4 by the magnetic field generated by the coil 3*a* and the movable contact 8*b* is disposed at a position of spanning the fixed contacts 7*a* and 7*d*. Thereby, the electric current from the positive terminal 2*a* flows in a direction directed to the load terminal 2*d* from the load terminal 2*c* ("A" direction in the drawing), and the motor M is driven to regularly rotate. Further, the electric current reaching to the load terminal 2*d* reaches to the fixed contact 7*b* via the movable contact 9*b* provided at the front end of the iron core 9*a* and flows to the negative terminal 2*b*.

Meanwhile, when the switch S of the operating means 10 is moved to the right side of FIG. 5, the electric current flows to the coil 3*b* and therefore, the iron core 9*a* is moved to the lower side in FIG. 4 by the magnetic field generated by the coil 3*b*, and the movable contact 9*b* provided at the front end is disposed at the position spanning the fixed contacts 7*a* and 7*e*. Thereby, the electric current from the positive side terminal 2*a* flows in a direction directed to the load terminal 2*c* from the load terminal 2*d* ("B" direction in the drawing) and the motor M is driven to reversely rotate. Further, the electric current reaching to the load terminal 2*c* reaches to the fixed contact 7*b* via the fixed contact 7*d*, and the movable contact 8*b* provided at the front end of the iron core 8*a* and flows to the negative terminal 2*b*.

Here, according to the embodiment, the ground lines 3*ab* and 3*bb* extended from the coils 3*a* and 3*b* are connected to the negative terminal 2*b* at inside of the case 1 and therefore, the waterproof performance can be improved in comparison with the constitution of arranging the ground line at the external portion as in the related art.

Further, the electromagnetic relay 4 according to the invention is a multiple connected electromagnetic relay arranged with a plurality (specifically, two) of the coils at inside of the case 1, the board 5 is arranged at inside of the case 1, the respective ground lines 3*ab* and 3*bb* extended from the respective coils 3*a* and 3*b* are connected to the negative terminal 2*b* via the board 5 and therefore, wiring can be simplified and operability in fabricating the electromagnetic relay system can be promoted.

Further, the coil spring 6 made of the conductive material is interposed between the board 5 and the negative side terminal 2*b*, the ground lines 3*ab* and 3*bb* are connected to the negative terminal 2*b* via the coil spring 6 and therefore, the connection is executed while exerting an elastic force of the coil spring 6 and the wiring of the electromagnetic relay system can further be simplified. That is, in integrating the lid 1*a* to cover the cabinet 1*b*, the coil spring 6 projected upward from the board 5 is projected to the fixed contact 7*b* arranged on the side of the lid 1*a* to produce the elastic force and therefore, the both members can electrically be connected in a state of being exerted with the predetermined press contact force.

Although an explanation has be given of the embodiment as described above, the invention is not limited thereto but may be applied to, for example, a constitution of containing a single one of the coil in the case, or a constitution containing three or more of the coils in the case so far as the electromagnetic relay is arranged in the case, and the ground line extended from the coil is connected to the negative terminal in the case. Further, the ground line extended from the coil constituting the electromagnetic relay may be connected to the negative terminal in the case without interposing the board.

Further, although according to the embodiment, the spring interposed between the board and the negative terminal is constituted by the coil spring, the coil may be constituted by other spring (leaf spring or the like) so far as the spring is a spring comprising the conductive material. Furthermore, although the electromagnetic relay system according to the embodiment is applied as an apparatus of switching to rotate regularly and rotate reversely the motor for driving the winch provided to the ATV, the electromagnetic relay system can be applied also as an electromagnetic relay system of other load of, for example, driving means for tilting an outboard motor or the like.

Further, the present invention is applicable to a constitution having a different outlook shape or a constitution added with other function so far as the constitution is an electromagnetic relay system in which a ground line extended from a coil is connected to a negative terminal at inside of a case.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. An electromagnetic relay system comprising:

an electromagnetic relay arranged in a case and including a coil, a movable contact and a plurality of fixed contacts;

a positive terminal formed to project from the case and connectable to a power source at a positive pole side;

a negative terminal formed to project from the case and connectable to the power source at a negative pole side;

a load terminal formed to project from the case and connectable to a load, wherein an electric current in the load is controlled by controlling an electric current in the coil;

a ground line extended from the coil and indirectly connected to the negative terminal within the case;

a board arranged in the case, wherein the ground line is connected to the negative terminal via the board; and a spring comprising a conductive material and interposed between the board and the negative terminal, wherein the ground line is connected to the negative terminal via the spring.

2. The electromagnetic relay system according to claim 1, wherein the electromagnetic relay comprises a multiple connected type electromagnetic relay arranged with a plurality of the coils in the case.

3. An electromagnetic relay system comprising:

an electromagnetic relay arranged in a case and including a coil, a movable contact and a plurality of fixed contacts;

a positive terminal formed to project from the case and connectable to a power source at a positive pole side;

a negative terminal formed to project from the case and connectable to the power source at a negative pole side;

a load terminal formed to project from the case and connectable to a load, wherein an electric current in the load is controlled by controlling an electric current in the coil;

a ground line extended from the coil and connected to the negative terminal in the case;

a board arranged in the case, wherein the ground line is connected to the negative terminal via the board; and a spring comprising a conductive material and interposed between the board and the negative terminal, wherein the ground line is connected to the negative terminal via the spring.

4. The electromagnetic relay system according to claim 3, wherein the electromagnetic relay comprises a multiple connected type electromagnetic relay arranged with a plurality of the coils in the case.

5. An electromagnetic relay system comprising:

an electromagnetic relay arranged in a case and including a coil, a movable contact and a plurality of fixed contacts;

a positive terminal formed to project from the case and connectable to a power source at a positive pole side;

a negative terminal formed to project from the case and connectable to the power source at a negative pole side;

a load terminal formed to project from the case and connectable to a load, wherein an electric current in the load is controlled by controlling an electric current in the coil; and a ground line extended from the coil and connected to the negative terminal in the case, wherein the electromagnetic relay comprises a multiple connected type electromagnetic relay arranged with a plurality of coils in the case, wherein the plurality of coils includes a first coil and a second coil, and a first iron core is inserted in the first coil, and a second iron core is inserted in the second coil.

* * * * *